US011583117B2

(12) United States Patent
Luchak

(10) Patent No.: US 11,583,117 B2
(45) Date of Patent: Feb. 21, 2023

(54) BEVERAGE SYSTEM

(71) Applicant: Peter Luchak, London (CA)

(72) Inventor: Peter Luchak, London (CA)

( * ) Notice: Subject to any disclaimer, the term of this patent is extended or adjusted under 35 U.S.C. 154(b) by 369 days.

(21) Appl. No.: 16/829,042

(22) Filed: Mar. 25, 2020

(65) Prior Publication Data

US 2020/0305618 A1 Oct. 1, 2020

Related U.S. Application Data

(60) Provisional application No. 62/825,068, filed on Mar. 28, 2019.

(51) Int. Cl.

| | |
|---|---|
| ***A47G 23/03*** | (2006.01) |
| ***A47G 19/12*** | (2006.01) |
| ***B65D 25/28*** | (2006.01) |
| ***B65D 25/24*** | (2006.01) |

(52) U.S. Cl.

CPC ..... *A47G 19/12* (2013.01); *B65D 25/24* (2013.01); *B65D 25/2811* (2013.01)

(58) Field of Classification Search

CPC ..... A47G 19/12; A47G 23/03; A47G 23/032; B65D 25/24; B65D 25/2811

USPC ..... 220/574, 630; 222/465.1

See application file for complete search history.

(56) References Cited

U.S. PATENT DOCUMENTS

| | | | | |
|---|---|---|---|---|
| 269,909 | A * | 1/1883 | Armstrong | B65D 25/48 222/465.1 |
| 3,094,235 | A * | 6/1963 | Luning | A47G 23/03 215/393 |
| 5,018,695 | A | 5/1991 | Bishop | |
| 5,024,014 | A | 6/1991 | Swierczek | |
| 2014/0122770 | A1 | 5/2014 | Chen | |
| 2015/0122770 | A1 | 5/2015 | Ciffone et al. | |
| 2016/0360910 | A1 | 12/2016 | Chiriga | |
| 2017/0251853 | A1 | 9/2017 | Chung | |
| 2018/0125275 | A1 | 5/2018 | Loeb et al. | |

FOREIGN PATENT DOCUMENTS

| | | | |
|---|---|---|---|
| DE | 7309486 | U | 3/1973 |
| DE | 2301953 | A1 | 7/1974 |
| DE | 8402902 | U1 | 4/1984 |
| DE | 10158044 | A1 | 6/2003 |
| GB | 2407755 | A | 11/2005 |

* cited by examiner

*Primary Examiner* — Don M Anderson
*Assistant Examiner* — Elizabeth J Volz
(74) *Attorney, Agent, or Firm* — Black McCuskey

(57) ABSTRACT

A beverage system can include a pitcher and at least one coaster. The pitcher can contain a quantity of a beverage and extend along a vertical axis between an upwardly-facing opening at the top and a first closed end. The pitcher can also include a base portion having a second wall defining a downwardly-facing opening. The base portion can also include a second closed end adjacent to the first closed end. The at least one coaster can be selectively engageable with the base portion and thereby positionable inside the base portion.

20 Claims, 11 Drawing Sheets

BEVERAGE SYSTEM

CROSS-REFERENCE TO RELATED APPLICATIONS

This application claims the benefit of U.S. Provisional Patent Application Ser. No. 62/825,068 for a BEVERAGE SYSTEM, filed on Mar. 28, 2019, which is hereby incorporated by reference in its entirety.

BACKGROUND

1. Field

The present disclosure relates to beverage-containing vessels and coasters.

2. Description of Related Prior Art

U.S. Pub. No. 2018/0125275 discloses LIQUID CONTAINING VESSELS WITH INTEGRATED COASTER. The liquid containing vessels have an upper portion, channel, base, and integrated coaster. The upper portion retains some amount of liquid. The channel is disposed beneath the upper portion and above the above the base. The channel is formed from a central stem connecting the upper portion to the base and a cavity that surrounds the stem for some radius that is less than a radius of the upper portion or base. Disposed in the channel is the integrated coaster. The integrated coaster is a trapping element that in some embodiments is a solid porous ring of an adsorptive or absorptive material. Condensation forming about the outer surface of the upper portion drips downwards towards the channel. The channel redirects the condensation to the trapping element where it is removed by the adsorptive or absorptive materials.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A beverage system can include a pitcher and at least one coaster. The pitcher can be configured to contain a quantity of a beverage. The pitcher can extend vertically along a vertical axis between a top edge and a bottom edge. The pitcher can include a beverage-holding portion having a first wall extending about the vertical axis and forming an upwardly-facing opening at the top edge. The beverage-holding portion can also include a first closed end spaced along the vertical axis from the upwardly-facing opening. The pitcher can also include a base portion having a second wall extending about the vertical axis and forming a downwardly-facing opening at the bottom edge. The base portion can also include a second closed end spaced along the vertical axis from the downwardly-facing opening. The first closed end and the second closed end can face in opposite directions along the vertical axis. The second wall can have an outer surface spaced from the vertical axis at least a first radius and also have an inner surface spaced from the vertical axis a second radius. The inner surface of the second wall can face toward the vertical axis and the outer surface can face away from the vertical axis. The at least one coaster can have a center and a perimeter spaced from the center at least a third radius. The at least one coaster can be selectively engageable with the base portion and thereby positionable inside the second wall between the bottom edge and the second closed end along the vertical axis.

BRIEF DESCRIPTION OF THE DRAWINGS

The detailed description set forth below references the following drawings.

DETAILED DESCRIPTION

Figure 1:
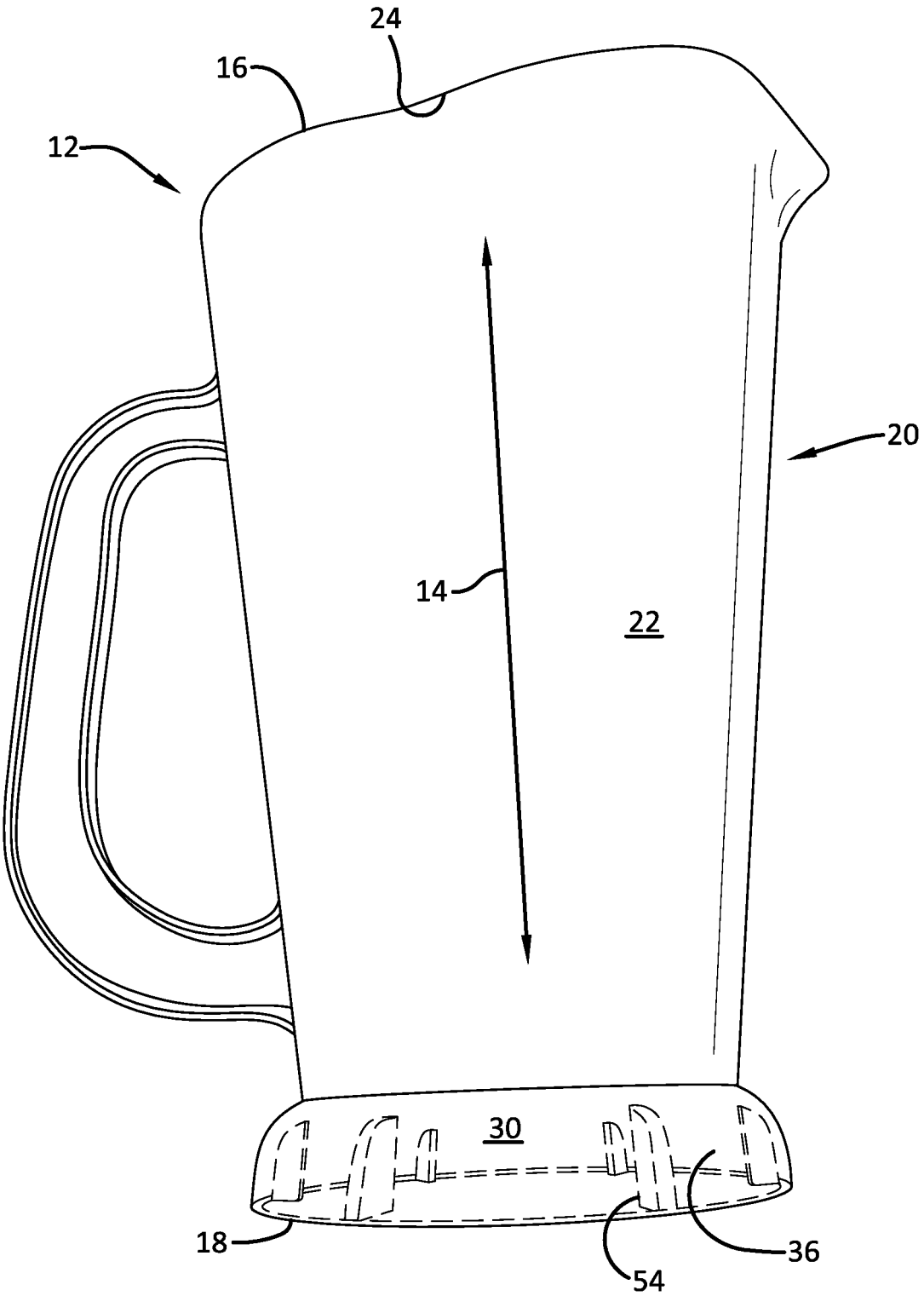
FIG. 1 is a first perspective and generally front view of a pitcher according to an exemplary embodiment of the present disclosure.
Figure 2:
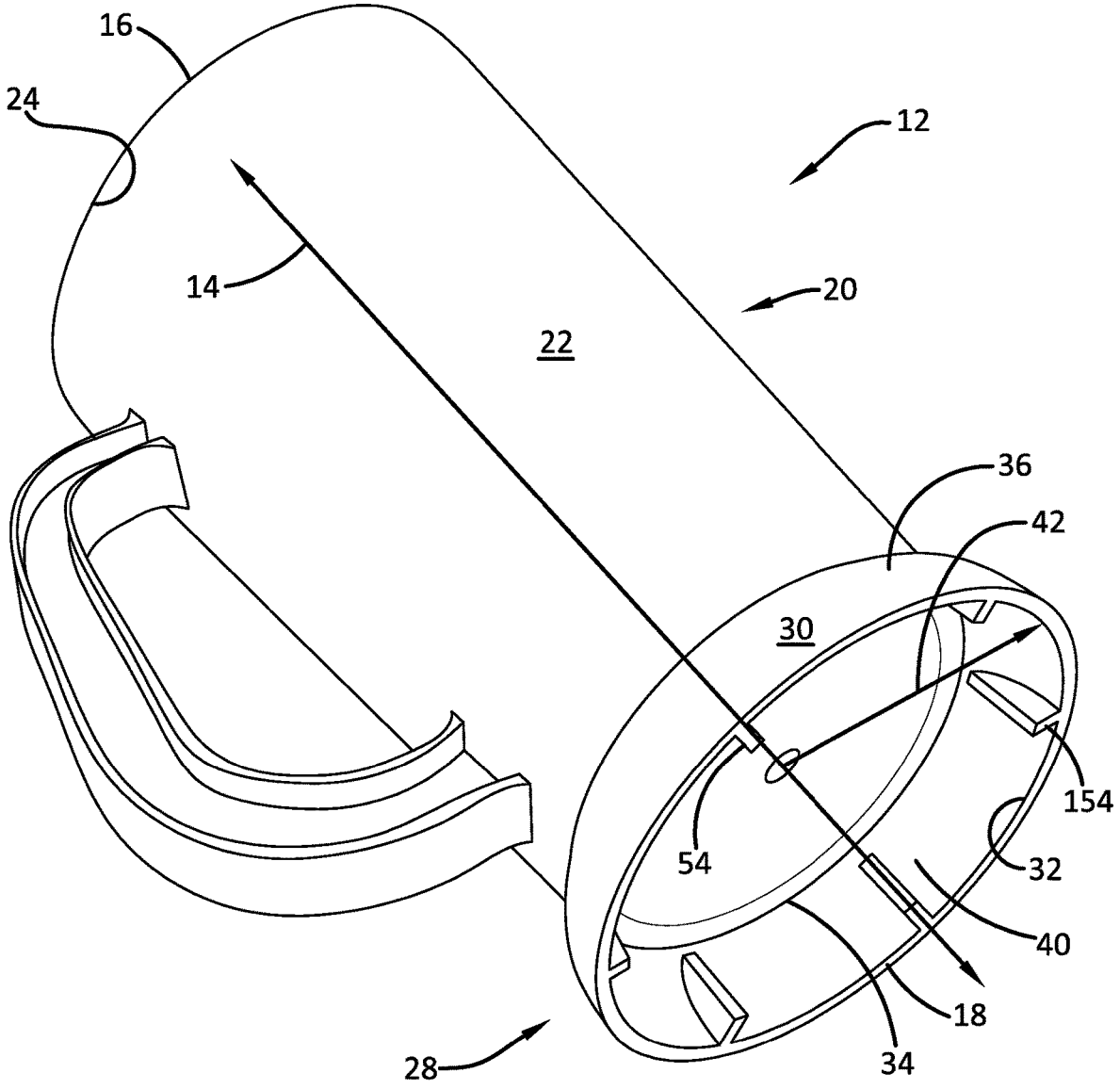
FIG. 2 is a second perspective view of the pitcher shown in FIG. 1.

The present disclosure, as demonstrated by the exemplary embodiment described below, can provide a beverage system. An exemplary beverage system 10 includes a pitcher 12 configured to contain a quantity of a beverage. The pitcher 12 can be formed from any material that can contain a quantity of a beverage. The exemplary pitcher 12 is formed from plastic. The exemplary pitcher 12 extends vertically along a vertical axis 14 between a top edge 16 and a bottom edge 18.

The exemplary pitcher 12 includes a beverage-holding portion 20 having a first wall 22 extending about the vertical axis 14. The exemplary first wall 22 forms an upwardly-facing opening 24 at the top edge 16. The shape of the opening 24 can be chosen as desired. The exemplary first wall 22 also forms a first closed end 26 spaced along the vertical axis 14 from the upwardly-facing opening 24. A beverage can be retained in the beverage-holding portion 20.

The exemplary pitcher 12 also includes a base portion 28. The exemplary base portion 28 includes a second wall 30 extending about the vertical axis 14. It is noted that the walls 22, 30 may or may not be centered on the axis 14. The exemplary walls 22, 30 are centered on the axis 14. The exemplary wall 30 forms a downwardly-facing opening 32 at the bottom edge 18 and a second closed end 34 spaced along the vertical axis 14 from the downwardly-facing opening 32. The first closed end 26 and the second closed end 34 face in opposite directions along the vertical axis 14.

The exemplary second wall 30 has an outer surface 36 spaced from the vertical axis 14 a first radius 38. A channel 55 can be defined at the intersection of the walls 22, 30 to catch condensation. The exemplary first radius 38 is variable. The exemplary second wall 30 also has an inner surface 40 spaced from the vertical axis 14 a second radius 42. The exemplary second radius 42 is variable. The inner surface 40 of the second wall 30 faces the vertical axis 14 and the outer surfaces 36 faces away from the vertical axis 14.

The exemplary beverage system 10 also includes at least one coaster 44 having a center 46 and perimeter 48 spaced from the center a third radius 50. The coaster 44 is selectively engageable with the base portion 28 and thereby positionable inside the second wall 30. The exemplary coaster 44 and the base portion 28 can be selectively engagable with one another. In other words, the exemplary coaster 44 can be mounted on the base portion 28 to accomplish retaining the exemplary coaster 44 within the cavity defined by the exemplary second wall 30. The exemplary coaster 44 and the exemplary base portion 28 can be selectively engagable with one another in that the exemplary coaster 44 can be removed from the base portion 28 without damage to the exemplary coaster 44 or the base portion 28 and re-attached to again accomplish retaining the exemplary coaster 44 within the cavity defined by the exemplary second wall 30. The exemplary coaster 44 and the exemplary base portion 28 can be selectively engagable with one another in that the exemplary coaster 44 or the base portion 28 can be replaced relative to the other, with a newer version, and engage the remaining component. The exemplary coaster 44 is mountable in a press-fit relationship with the base portion 28 such that the exemplary coaster 44 is slightly and elastically deformed when positioned in the base portion 28. The coaster 44 can be positioned inside the second wall 30 between the bottom edge 18 and the second closed end 34 along the vertical axis 14.

The exemplary beverage system 10 further comprises a plurality of protuberances, such as protuberances 54 and 154, spaced from one another about the vertical axis 14. Each of the exemplary protuberances are the same shape and therefore one will be described in detail. However, it is noted that embodiments of the present disclosure can be practiced with differently-shaped protuberances.

Figure 7:
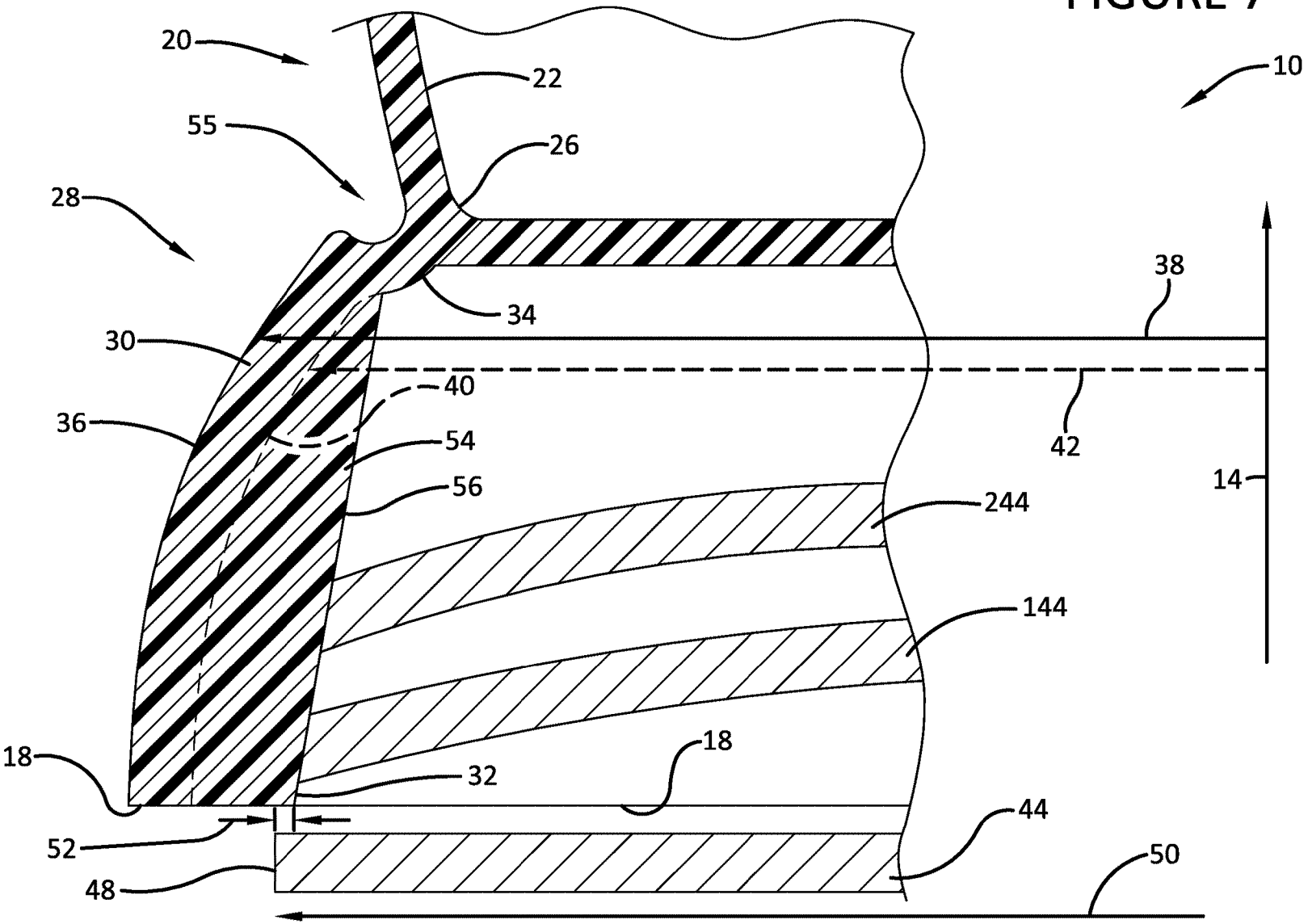
FIG. 7 is a cross-section of part of the base portion of the pitcher shown in FIG. 1 with a plurality of coasters.

The exemplary protuberance 54 projects toward the vertical axis 14, away from the inner surface 40 of the second wall 30. The exemplary protuberance 54 defines an edge 56 facing the vertical axis 14. The exemplary edge 56 is a curved surface having a relatively large radius of curvature, so as to appear flat (such as a portion of a conical surface). Also, for the exemplary edge 56, a distance between the edge 56 and the vertical axis 14 is variable. The exemplary edge slopes away from the vertical axis 14 in a direction along the axis 14 starting at the second closed end 34 toward the downwardly-facing opening 32. This is best shown in FIG. 7. The distance between the edge 56 and the vertical axis 14 increases at positions along the axis from the second closed end 34 to the downwardly-facing opening 32.

As set forth above, the coaster 44 is mountable in a press-fit relationship with the one or more of the protuberances 54, 154 of the base portion 28. In the exemplary embodiment, the coaster 44 is slightly larger than the distance between the edges 56 of the various protuberances 56. At 52, FIG. 7 references a slightly overlap between the radius 50 of coaster 44 and distance between the edge 56 and the axis 14. The exemplary coaster 44 is elastically-deformable and deforms when the perimeter 48 is inserted into the base portion 28 to engage with the one or more edges 56.

FIG. 7 also shows the coaster 44 prior to insertion into the base portion 28 and also shows two other coasters 144 and 244. The coaster 144 has been received in the base portion 28 and is slightly more deformed, or arced, than the coaster 44. The coaster 244 has been received further into the base portion 28 than the coaster 144 and is slightly more deformed, or arced, than the coaster 144. As shown by FIG. 7, the perimeters of the coasters 144, 244 are spaced from the inner surface 40 of the second wall 30 when positioned in the base portion 28. This allows a user to easily extract the coasters 144, 244 when desired for use. Further, the coaster 44 can be formed from any material or combination of materials desired, that permits the coaster 44 to deform for insertion in the base portion 28. Cardboard, plastic, and neoprene are exemplary materials. It is noted that one or more embodiments of the present disclosure can include a plurality of coasters mounted in a base portion.

The coaster 44 can also embody other features to enhance the functionality of the combination of the coaster 44 and the pitcher 12. For example, the coaster 44 can bear indicia. The coaster 44 can include a primary portion with secondary portions that can be removed from the primary portion. The secondary portions can be utilized for other functions while the primary portion is utilized as a coaster.

Figure 3:
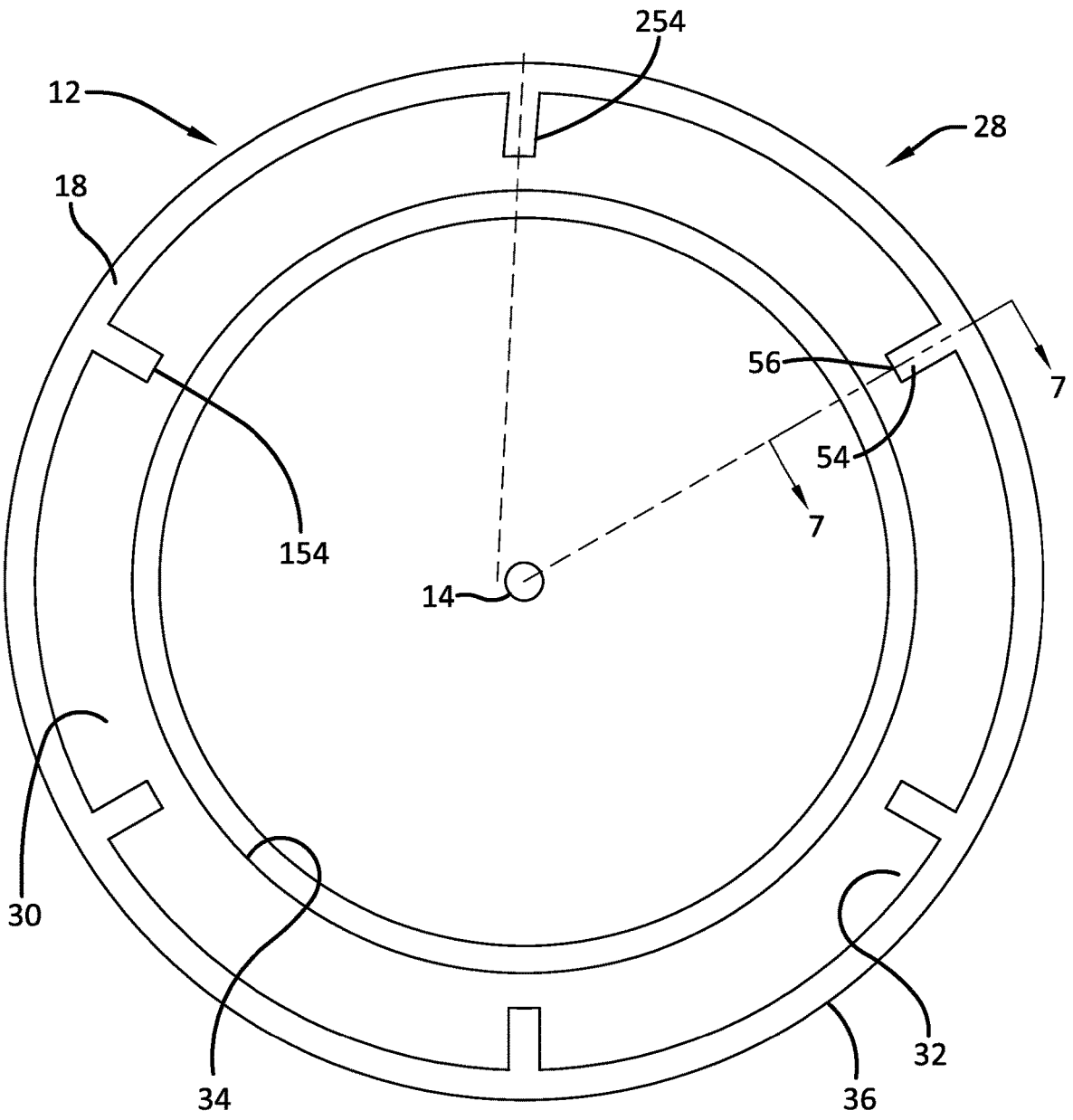
FIG. 3 is a bottom view (looking upward) of the pitcher shown in FIG. 1.
Figure 4:
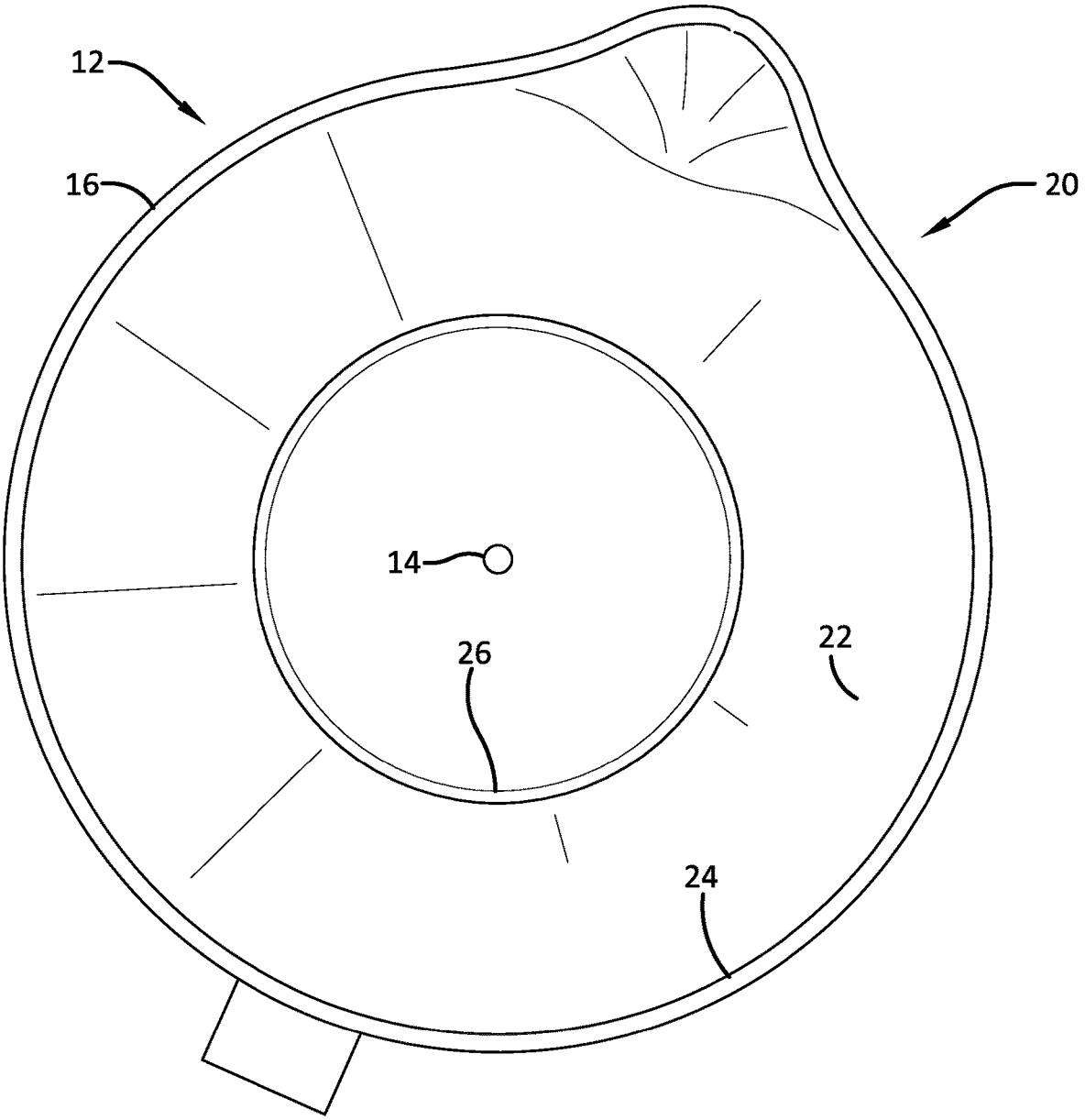
FIG. 4 is a top view (looking down) of the pitcher shown in FIG. 1.
Figure 5:
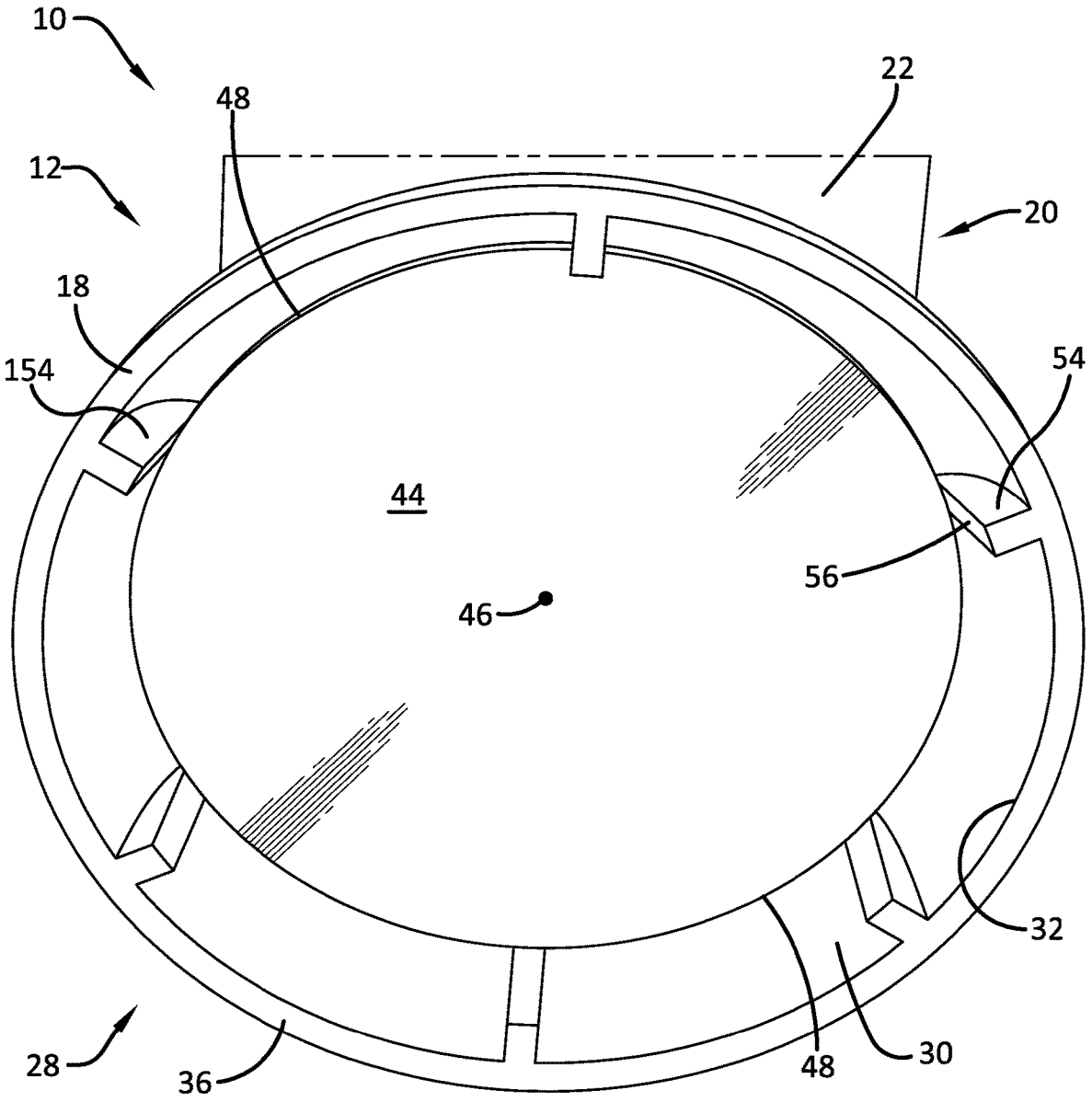
FIG. 5 is a perspective view of a bottom of the pitcher shown in FIG. 1 with a coaster positioned in a base portion of the pitcher.
Figure 6:
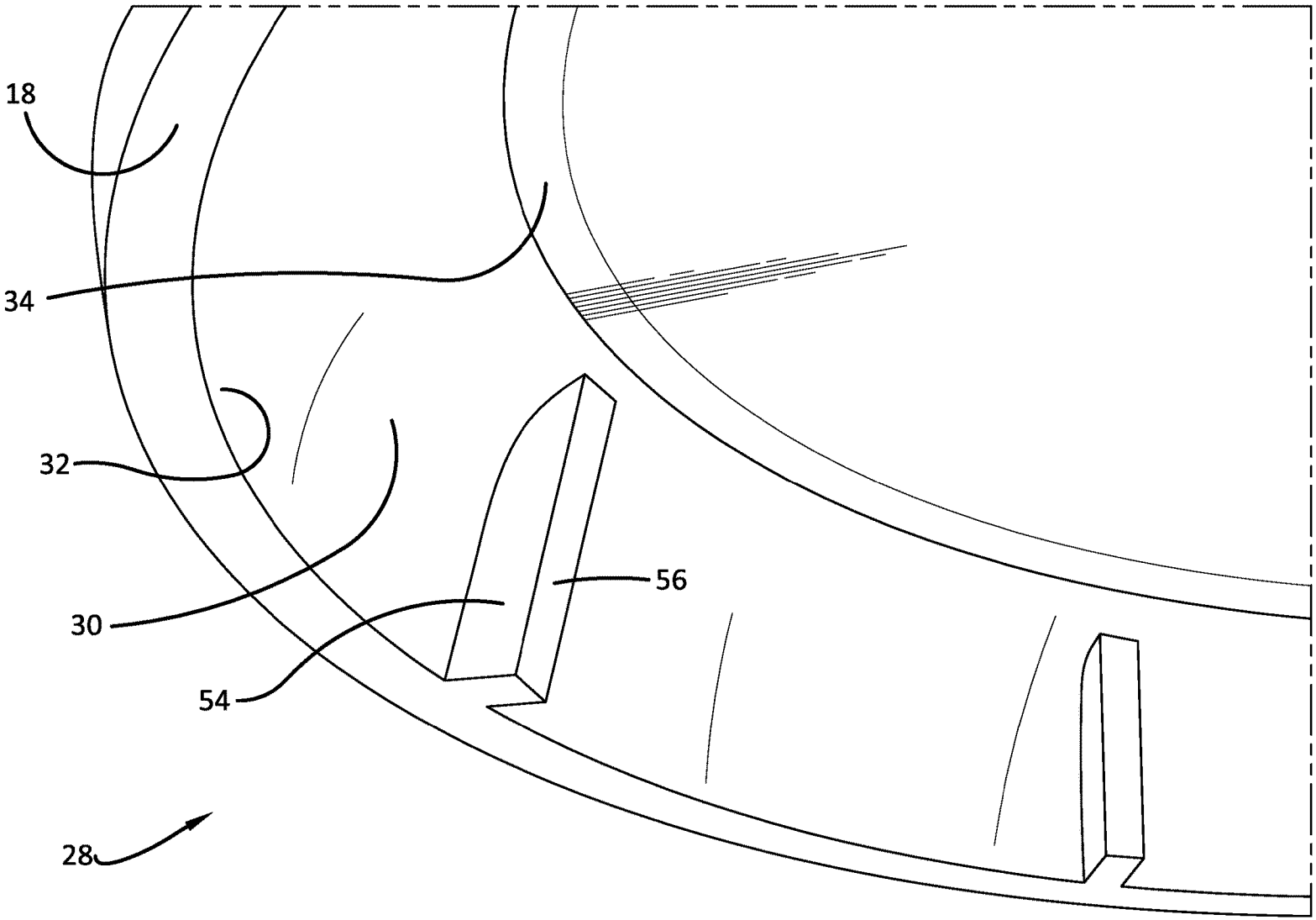
FIG. 6 is a perspective view of the base portion of the pitcher shown in FIG. 1.

One or more of the protuberances, such as 54 and/or 154, can project normal to the vertical axis 14 from the inner surface 40. In other words, an axis along with the protuberance extends from the second wall 30 intersects the vertical axis 14. This is shown in FIG. 3 by protuberance 54. Alternatively, one or more of the protuberances can extend away from the inner surface 40 along an axis of extension that does not intersect the vertical axis 14. Such a protuberance is referenced at 254 in FIG. 3.

As set forth above, the distance between the edge 56 and the vertical axis 14 is variable; the portion of the edge 56 at the bottom edge 18 is at a greater distance from the axis 14 than the portion of the edge 56 closest to the second closed end 34. In the embodiment shown in FIG. 7, the distance between the edge 56 and the vertical axis 14 increases along the vertical axis 14 from the second closed end 34 to the downwardly-facing opening 32. In other words, the distance between the edge 56 and the vertical axis 14 at a first position along the vertical axis 14, wherein the first position is closer to the second closed end 34 than a second position along the vertical axis 14, is less than the distance between the edge 56 and the vertical axis 14 at the second position, wherein the second position is closer to the downwardly-facing opening 32 than the first position. The distance between the edge 56 and the vertical axis 14 continually increases along the vertical axis 14 from the second closed end 34 to the downwardly-facing opening 32.

Figure 8:
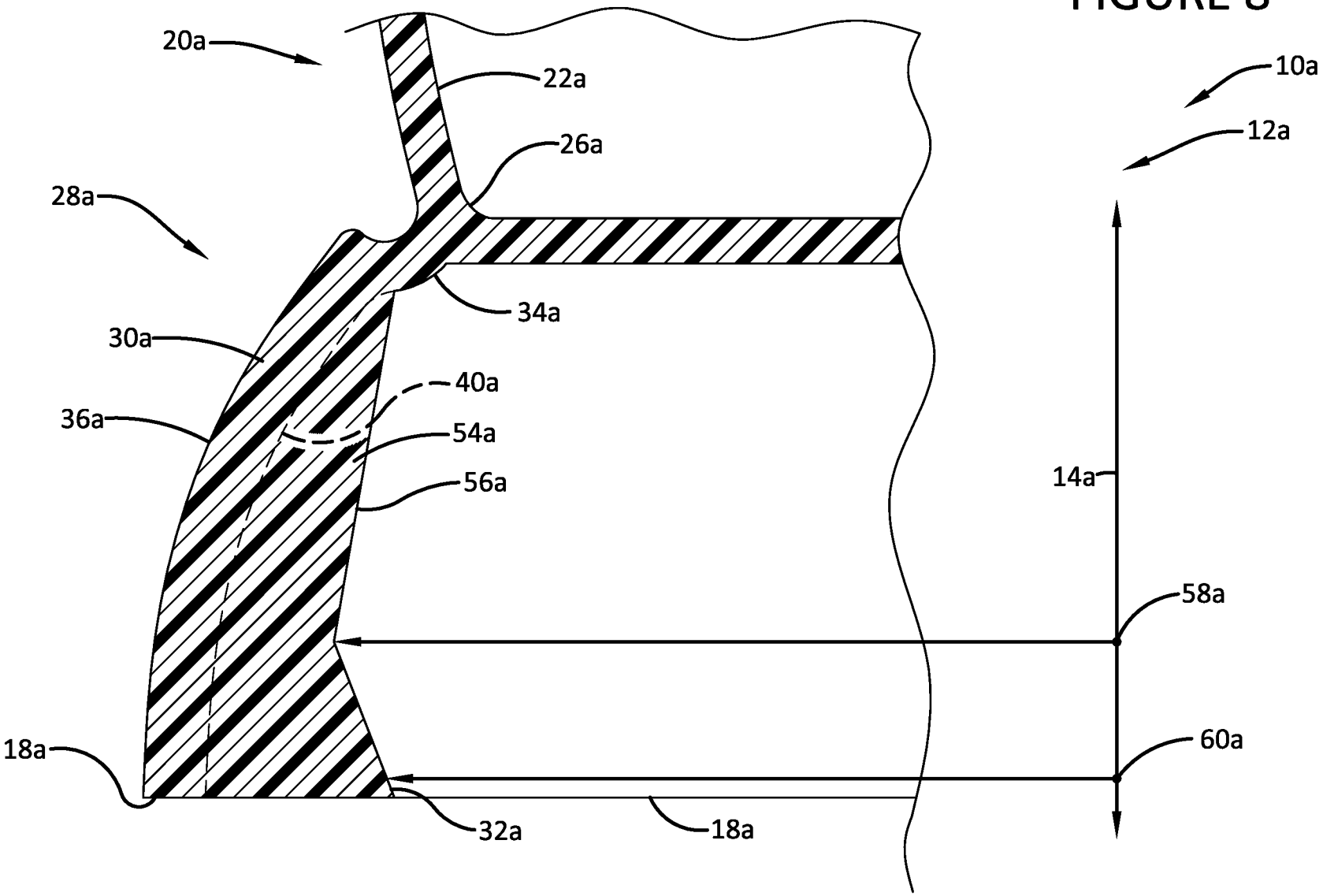
FIG. 8 is a cross-section of part of a base portion of a pitcher according to an alternative embodiment of the present disclosure.

FIG. 8 is a cross-section of a base portion of a pitcher according to an alternative embodiment of the present disclosure. An exemplary beverage system 10*a* includes a pitcher 12*a* configured to contain a quantity of a beverage. The pitcher 12*a* can be formed from any material that can contain a quantity of a beverage. The exemplary pitcher 12*a* is formed from plastic. The exemplary pitcher 12*a* extends vertically along a vertical axis 14*a* between a top edge (not visible) and a bottom edge 18*a*.

The exemplary pitcher 12*a* includes a beverage-holding portion 20*a* having a first wall 22*a* extending about the vertical axis 14*a*. The exemplary first wall 22*a* forms an upwardly-facing opening (not visible) at the top edge. The shape of the opening can be chosen as desired. The exemplary first wall 22*a* also forms a first closed end 26*a* spaced along the vertical axis 14*a* from the upwardly-facing opening. A beverage can be retained in the beverage-holding portion 20*a*.

The exemplary pitcher 12*a* also includes a base portion 28*a*. The exemplary base portion 28*a* includes a second wall 30*a* extending about the vertical axis 14*a*. It is noted that the walls 22*a*, 30*a* may or may not be centered on the axis 14*a*. The exemplary wall 30*a* forms a downwardly-facing opening 32*a* at the bottom edge 18*a* and a second closed end 34*a* spaced along the vertical axis 14*a* from the downwardly-facing opening 32*a*. The first closed end 26*a* and the second closed end 34*a* face in opposite directions along the vertical axis 14*a*.

The exemplary second wall 30*a* has an outer surface 36*a* and an inner surface 40*a*. The inner surface 40*a* of the second wall 30*a* faces the vertical axis 14*a* and the outer surfaces 36*a* faces away from the vertical axis 14*a*. The exemplary beverage system 10*a* further comprises a plurality of protuberances, such as protuberance 54*a*. The exemplary protuberance 54*a* projects toward the vertical axis 14*a*, away from the inner surface 40*a* of the second wall 30*a*. The exemplary protuberance 54*a* defines an edge 56*a* facing the vertical axis 14*a*. A coaster, such as coaster 44, can be engaged with the exemplary protuberance 54*a* and any other protuberances to selectively engage the coaster with the base portion 28*a* and thereby position the coaster inside the second wall 30*a*.

The distance between the edge 56*a* and the vertical axis 14*a* decreases at positions along the vertical axis 14*a* from the second closed end 34*a* to the downwardly-facing opening 32*a*. In other words, the distance between the edge 56*a* and the vertical axis 14*a* at a first exemplary position 58*a* along the vertical axis 14*a*, wherein the first exemplary position 58*a* is closer to the second closed end 34*a* than a second exemplary position 60*a* along the vertical axis 14*a*, is greater than the distance between the edge 56*a* and the vertical axis 14*a* at the second exemplary position, wherein the second exemplary position 60*a* is closer to the downwardly-facing opening 32*a* than the first exemplary position 58*a*. FIG. 8 shows such an embodiment, wherein the profile of the edge 56*a* defines a slight notch at the first exemplary position 58*a*. The exemplary notch has the cross-section of the inside of an angle. A perimeter of a coaster can be captured at the first exemplary position 58*a* while the coaster is selectively engaged with the base portion 28*a* and thereby positioned inside the second wall 30*a*.

Figure 9:
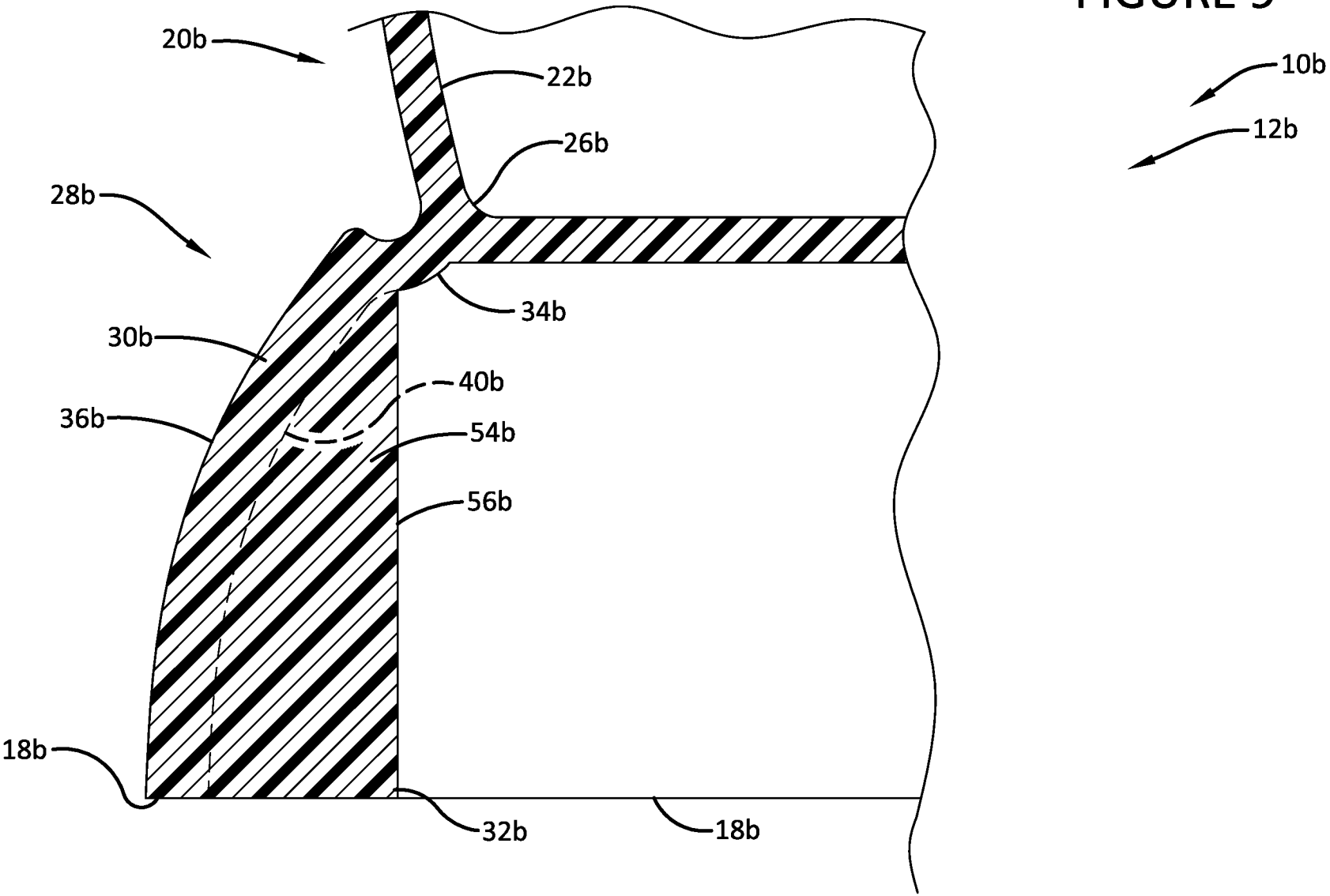
FIG. 9 is a cross-section of part of a base portion of a pitcher according to an alternative embodiment of the present disclosure.

FIG. 9 is a cross-section of a base portion of a pitcher according to an alternative embodiment of the present disclosure. An exemplary beverage system 10*b* includes a pitcher 12*b* configured to contain a quantity of a beverage. The pitcher 12*b* can be formed from any material that can contain a quantity of a beverage. The exemplary pitcher 12*b* is formed from plastic. The exemplary pitcher 12*b* extends vertically along a vertical axis 14*b* between a top edge (not visible) and a bottom edge 18*b*.

The exemplary pitcher 12*b* includes a beverage-holding portion 20*b* having a first wall 22*b* extending about the vertical axis 14*b*. The exemplary first wall 22*b* forms an upwardly-facing opening (not visible) at the top edge. The shape of the opening can be chosen as desired. The exemplary first wall 22*b* also forms a first closed end 26*b* spaced along the vertical axis 14*b* from the upwardly-facing opening. A beverage can be retained in the beverage-holding portion 20*b*.

The exemplary pitcher 12*b* also includes a base portion 28*b*. The exemplary base portion 28*b* includes a second wall 30*b* extending about the vertical axis 14*b*. It is noted that the walls 22*b*, 30*b* may or may not be centered on the axis 14*b*. The exemplary wall 30*b* forms a downwardly-facing opening 32*b* at the bottom edge 18*b* and a second closed end 34*b* spaced along the vertical axis 14*b* from the downwardly-facing opening 32*b*. The first closed end 26*b* and the second closed end 34*b* face in opposite directions along the vertical axis 14*b*.

The exemplary second wall 30*b* has an outer surface 36*b* and an inner surface 40*b*. The inner surface 40*b* of the second wall 30*b* faces the vertical axis 14*b* and the outer surfaces 36*b* faces away from the vertical axis 14*b*. The exemplary beverage system 10*b* further comprises a plurality of protuberances, such as protuberance 54*b*. The exemplary protuberance 54*b* projects toward the vertical axis 14*b*, away from the inner surface 40*b* of the second wall 30*b*. The exemplary protuberance 54*b* defines an edge 56*b* facing the vertical axis 14*b*. A coaster, such as coaster 44, can be engaged with the exemplary protuberance 54*b* and any other protuberances to selectively engage the coaster with the base portion 28*b* and thereby position the coaster inside the second wall 30*b*. The exemplary edge 56*b* defines a cylindrical surface, having the same distance from the vertical axis 14*b* along its height (defined along the vertical axis 14*b*).

Figure 10:
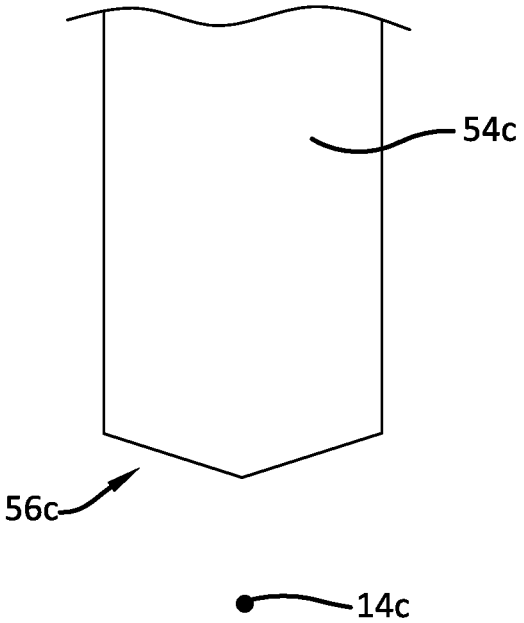
FIG. 10 is a bottom view (looking upward) of a portion of a pitcher according to an alternative embodiment of the present disclosure.
Figure 11:
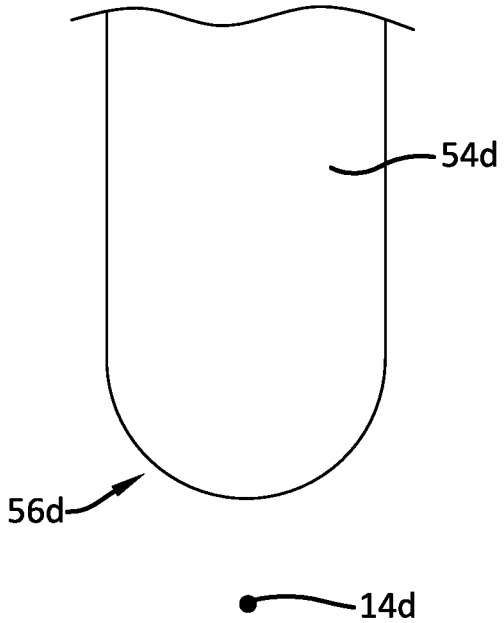
FIG. 11 is a bottom view (looking upward) of a portion of a pitcher according to an alternative embodiment of the present disclosure.
Figure 12:
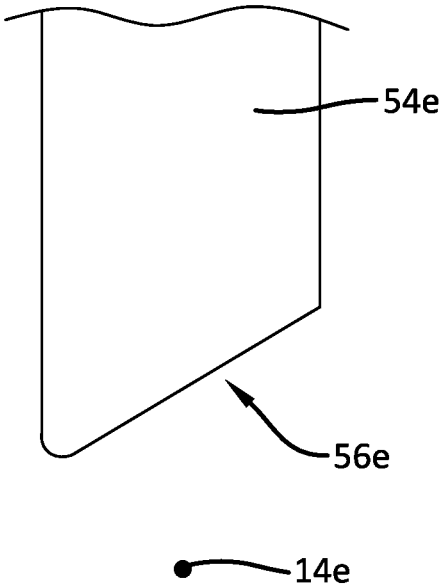
FIG. 12 is a bottom view (looking upward) of a portion of a pitcher according to an alternative embodiment of the present disclosure.
Figure 13:
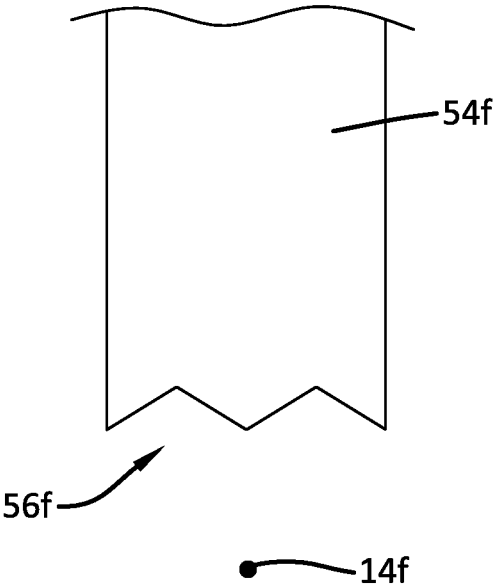
FIG. 13 is a bottom view (looking upward) of a portion of a pitcher according to an alternative embodiment of the present disclosure.

FIGS. 10-13 show alternative embodiments in which the distance between an edge of a protuberance and a vertical axis increases at positions about the vertical axis. FIGS. 10-13 show sections of alternative protuberances in a plane that is normal to the vertical axis. It is noted that the vertical axis is referenced in these Figures to clarify direction; the positions of the axis and the protuberance are not to scale. In FIG. 10, a protuberance 54*c* defines edge 56*c* that forms a point directed toward the axis 14*c*. In FIG. 11, a protuberance 54*d* defines edge 56*d* that forms a round directed toward the axis 14*d*. In FIG. 12, a protuberance 54*e* defines edge 56*e* that forms an offset tip and a blade-like edge toward the axis 14*e*. In FIG. 13, a protuberance 54*f* defines edge 56*e* that forms a saw-tooth pattern toward the axis 14*e*. These patterns can allow the coaster to be removed easier.

Figure 14:
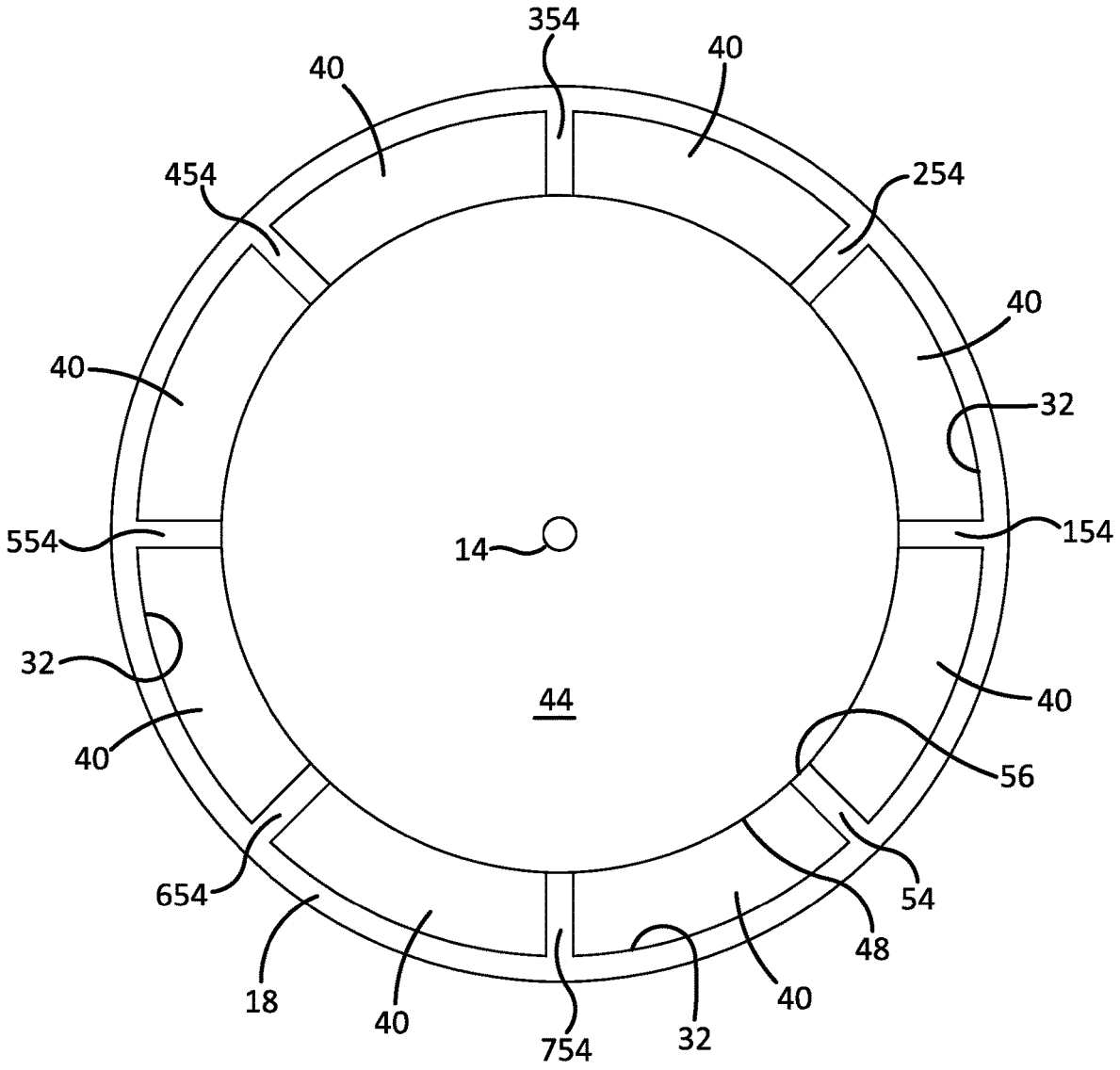
FIG. 14 is a bottom view (looking upward) at the first embodiment of the present disclosure.

FIG. 14 is a bottom view, looking upward, at the first embodiment of the present disclosure. The exemplary perimeter 48 is circular, is spaced from the inner surface 40, and is engaged with a plurality of protuberances 54-754. In alternative embodiments, a perimeter of a coaster may be non-circular and be spaced from only part of inner surface 40 and/or can be engaged less than all of the protuberances defined by pitcher. A perimeter of a coaster can be spaced from less than half, all, or more than half of the inner surface 40 when engaged with one or more of the protuberances. Alternatively, a perimeter of coaster can be in contact with at least part of the inner surface 40 when engaged with one or more of the respective protuberances. In such embodiments, the perimeter would have a different shape so that, for example, a gap shown in FIG. 14 between the perimeter 48 and the edge of the surface 40 (the downwardly-facing opening 32) would be filled with a portion of the coaster 44.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined strictly by the content of a patent claim and not by what is written in a detailed description of an embodiment of an invention.

What is claimed is:

1. A beverage system comprising:

a pitcher configured to contain a quantity of a beverage, said pitcher extending vertically along a vertical axis between a top edge and a bottom edge and including:

a beverage-holding portion having a first wall extending about said vertical axis and forming an upwardly-facing opening at said top edge and a first closed end spaced along said vertical axis from said upwardly-facing opening, a base portion having a second wall extending about said vertical axis and forming a downwardly-facing opening at said bottom edge and a second closed end spaced along said vertical axis from said downwardly-facing opening, said first closed end and said second closed end facing in opposite directions along said vertical axis, said second wall having an outer surface spaced from said vertical axis at least a first radius and also having an inner surface spaced from said vertical axis a second radius, said inner surface of said second wall facing toward said vertical axis and said outer surface facing away from said vertical axis;

at least one coaster having a center and a perimeter spaced from said center at least a third radius; and wherein said at least one coaster is selectively engageable with said base portion and thereby positionable inside said second wall between said bottom edge and said second closed end along said vertical axis.

2. The beverage system of claim 1 wherein said at least one coaster is further defined as selectively engageable with said base portion in a press-fit relationship with said base portion.

3. The beverage system of claim 1 further comprising:

at least one protuberance projecting toward said vertical axis from said inner surface of said second wall and defining an edge facing into a cavity defined by said inner surface, wherein said perimeter of said at least one coaster engages said edge when positioned in said base portion.

4. The beverage system of claim 3 wherein said at least one protuberance is further defined as projecting normal to said vertical axis from said inner surface.

5. The beverage system of claim 3 wherein said at least one protuberance is further defined as extending away from said inner surface along an axis that does not intersect said vertical axis.

6. The beverage system of claim 3 wherein a distance between said edge and said vertical axis is variable.

7. The beverage system of claim 6 wherein the distance between said edge and said vertical axis increases along said vertical axis from said second closed end to said downwardly-facing opening.

8. The beverage system of claim 6 wherein the distance between said edge and said vertical axis continually increases along said vertical axis from said second closed end to said downwardly-facing opening.

9. The beverage system of claim 6 wherein the distance between said edge and said vertical axis decreases at positions along said vertical axis from said second closed end to said downwardly-facing opening.

10. The beverage system of claim 3 wherein said edge is further defined as defining at least a portion of a cylindrical surface.

11. The beverage system of claim 3 wherein the distance between said edge and said vertical axis increases at positions about said vertical axis.

12. The beverage system of claim 3 wherein said at least one protuberance is further defined as:

a plurality of protuberances, spaced from one another about said vertical axis and each projecting toward said vertical axis from said inner surface of said second wall and defining a respective edge facing said vertical axis, wherein said perimeter of said at least one coaster engages at least a plurality of said respective edges when engaged with said base portion.

13. The beverage system of claim 12 wherein said perimeter is spaced from at least part of said inner surface of said second wall when engaged with said at least a plurality of said respective edges.

14. The beverage system of claim 13 wherein said perimeter is spaced from most of said inner surface of said second wall when engaged with said at least a plurality of said respective edges.

15. The beverage system of claim 12 wherein said perimeter is in contact with at least part of said inner surface of said second wall when engaged with said at least a plurality of said respective edges.

16. The beverage system of claim 3 wherein said perimeter is spaced from at least part of said inner surface of said second wall when engaged with said edge.

17. The beverage system of claim 16 wherein said perimeter is spaced from most of said inner surface of said second wall when engaged with said edge.

18. The beverage system of claim 3 wherein said perimeter is in contact with at least part of said inner surface of said second wall when engaged with said edge.

19. The beverage system of claim 1 wherein said at least one coaster is further defined as elastically deformable and is elastically deformed when said perimeter is engaged with said base portion.

20. The beverage system of claim 1 wherein a channel is defined at an intersection of an outer surface of said first wall and said outer surface of said second wall, said channel open upwardly to catch condensation flowing down said outer surface of said first wall.

* * * * *